United States Patent [19]

Jibril

[11] Patent Number: 5,042,796

[45] Date of Patent: Aug. 27, 1991

[54] EXERCISE APPARATUS

[76] Inventor: Mohammed A. Jibril, 150-29 Linden Blvd., Jamaica, N.Y. 11434

[21] Appl. No.: 636,185

[22] Filed: Dec. 31, 1990

[51] Int. Cl.[5] ..... A63B 21/00; A63B 21/065; A63B 21/068

[52] U.S. Cl. ..... 272/109; 272/117; 272/119; 272/93

[58] Field of Search ..... 272/93, 109, 116, 117, 272/119

[56] References Cited

U.S. PATENT DOCUMENTS

| | | | |
|---|---|---|---|
| 1,837,872 | 12/1931 | Johnson | 272/117 |
| 4,111,414 | 9/1978 | Roberts | 272/118 |
| 4,332,379 | 6/1982 | Bannister | 272/119 |
| 4,431,184 | 2/1984 | Lew et al. | 272/109 |
| 4,658,442 | 4/1987 | Tomlinson et al. | 272/119 |
| 4,948,122 | 8/1990 | Andrews, Sr. | 272/119 |
| 4,984,786 | 1/1991 | Leinke et al. | 272/117 |

*Primary Examiner*—Richard J. Apley
*Assistant Examiner*—Karen G. Horowitz
*Attorney, Agent, or Firm*—Leon Gilden

[57] ABSTRACT

An apparatus wherein a torso encircling bag is securable about an individual, with the bag including a chamber medially between a plurality of mounting straps, with the chamber receiving a predetermined number of resistance weights to enhance resistance during exercise such as in conventional push-ups. The organization utilizes an overlying plurality of pulleys, with the plate member mounted within the vest structure to provide assistance for individuals requiring such in an initial phase of convalescence in attempting push-up type exercise.

2 Claims, 4 Drawing Sheets

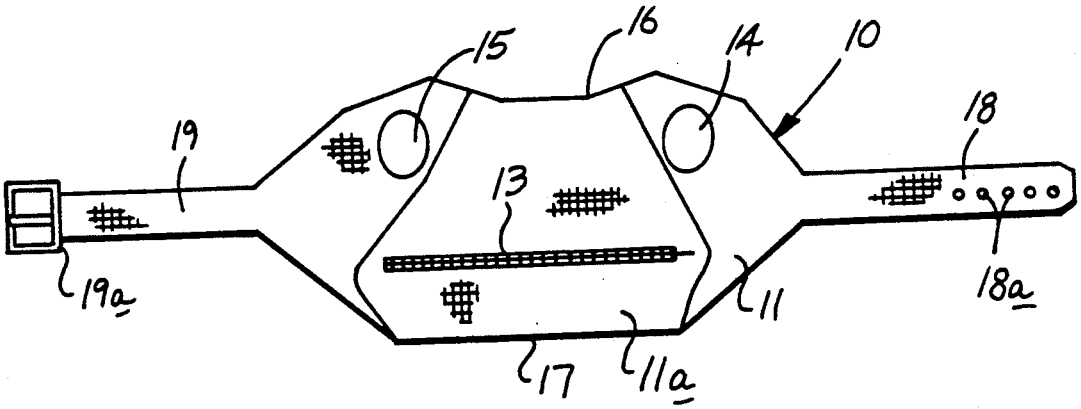
FIG 3
FIG 4
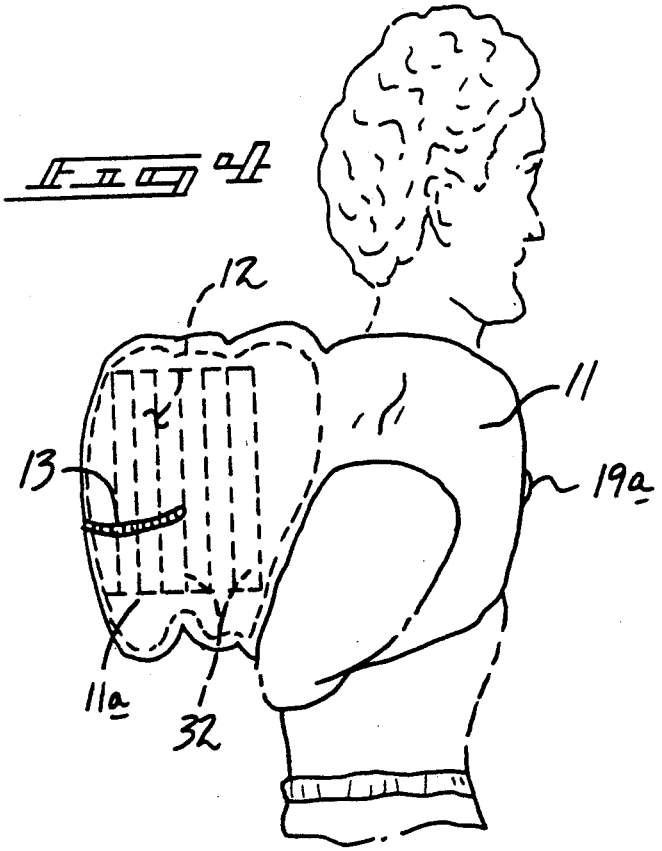

EXERCISE APPARATUS

BACKGROUND OF THE INVENTION

1. Field of the Invention

The field of invention relates to exercise apparatus, and more particularly pertains to a new and improved exercise apparatus wherein the same is arranged to provide selective resistance or assist in exercising by individuals.

2. Description of the Prior Art

Various prior art exercise apparatus has been available to provide resistance and the like for individuals in an exercise procedure. Such apparatus is exemplified in U.S. Pat. No. 4,714,247 wherein a platform is arranged underlying a plurality of gymnastic rings to provide resistance for individuals learning a routine in the planche position.

U.S. Pat. No. 4,213,605 to Mcpeak sets forth protective apparel mounted about a torso of an individual to support a barbell shaft for support of the shaft upon the shoulders of the individual.

U.S. Pat. No. 4,372,533 to Hatfieldd sets forth a platform wherein a neck strap is directed about an individual, wherein the strap is secured to a cable and the cable permits directing of various resistance weights to enhance strengthening of abdominal muscles of an individual.

U.S. Pat. No. 3,888,245 to Bertenson, et al. wherein a weighted belt is provided, wherein the belt includes slots for receiving various weights to enhance straightening of the lower back.

U.S. pat. No. 3,713,299 to Duncan sets forth a weighted belt for use by underwater divers with compartments containing lead weights therewithin.

As such, it may be appreciated that there continues to be a need for a new and improved exercise apparatus as set forth by the instant invention which addresses both the problems of ease of use as well as effectiveness in providing resistance and assist selectively in a push-up exercise procedure and in this respect, the present invention substantially fulfills this need.

SUMMARY OF THE INVENTION

In view of the foregoing disadvantages inherent in the known types of exercise apparatus now present in the prior art, the present invention provides an exercise apparatus wherein the same provides selective resistance and assistance weights to be used by an individual. As such, the genera]purpose of the present invention, which will be described subsequently in greater detail, is to provide a new and improved exercise apparatus which has all the advantages of the prior art exercise apparatus and none of the disadvantages.

To attain this, the present invention provides an apparatus wherein a torso encircling bag is securable about an individual, with the bag including a chamber medially between a plurality of mounting straps, with the chamber receiving a predetermined number of resistance weights to enhance resistance during exercise such as in conventional push-ups. The organization utilizes an overlying plurality of pulleys, with the plate member mounted within the vest structure to provide assistance for individuals requiring such in an initial phase of convalescence in attempting push-up type exercise.

My invention resides not in any one of these features per se but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise apparatus which has all the advantages of the prior art exercise apparatus and none of the disadvantages.

It is another object of the present invention to provide a new and improved exercise apparatus which may be easily and efficiently manufactured and marketed.

It is a further object of the present invention to provide a new and improved exercise apparatus which is of a durable and reliable construction.

An even further object of the present invention is to provide a new and improved exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new and improved exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 3 is an orthographic top view of the instant invention.

FIG. 4 is an orthographic side view of a torso vest mounted to an individual.

DESCRIPTION OF THE PREFERRED EMBODIMENT

Figures 1, 2:
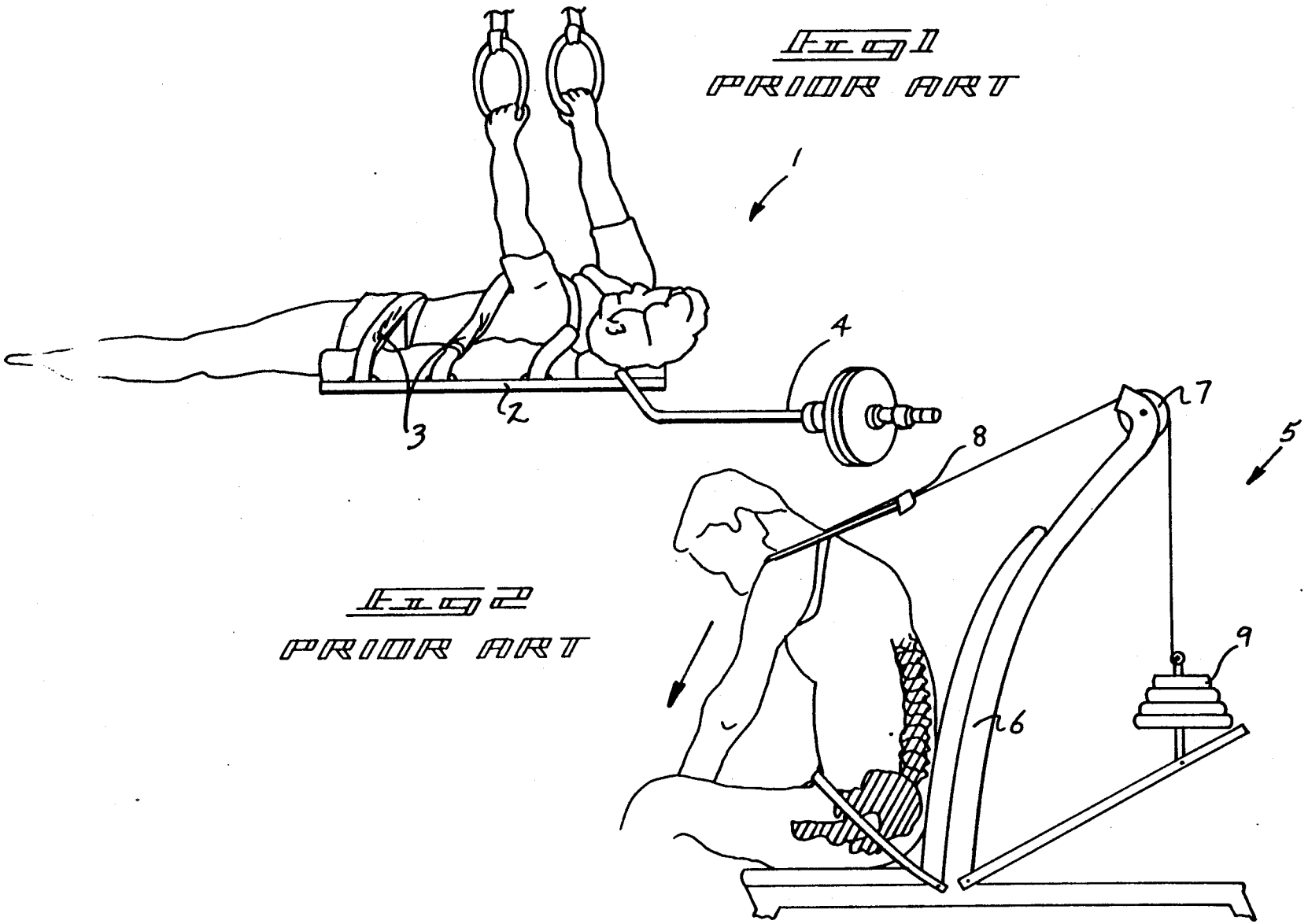
FIG 1 PRIOR ART
FIG 2 PRIOR ART
FIG. 1 is an isometric illustration of a prior art exercise apparatus.
FIG. 2 is an orthographic side view, taken in elevation, of a further example of a prior art exercise apparatus.

With reference now to the drawings, and in particular to FIGS. 1 to 8 thereof, a new and improved exercise apparatus embodying the principles and concepts of the present invention and generally designated by the reference numerals 10–32 will be described.

FIG. 1 illustrates a prior art exercise apparatus 1, wherein a platform 2 utilizes a series of straps 3 to secure the platform about a torso portion of an individual, wherein a bar 4 is directed outwardly of the platform, in a manner as set forth in U.S. Pat. No. 4,714,247.

U.S. Pat. No. 4,372,553 sets forth an exercise apparatus 5, as illustrated in FIG. 2, wherein a support bench 6 mounts a pulley 7 with a tether line extending over the pulley utilizing shoulder straps 8 for securement about an individual, with the line mounted to resistance weights 9 to enhance abdominal exercise by an individual.

Figure 5:
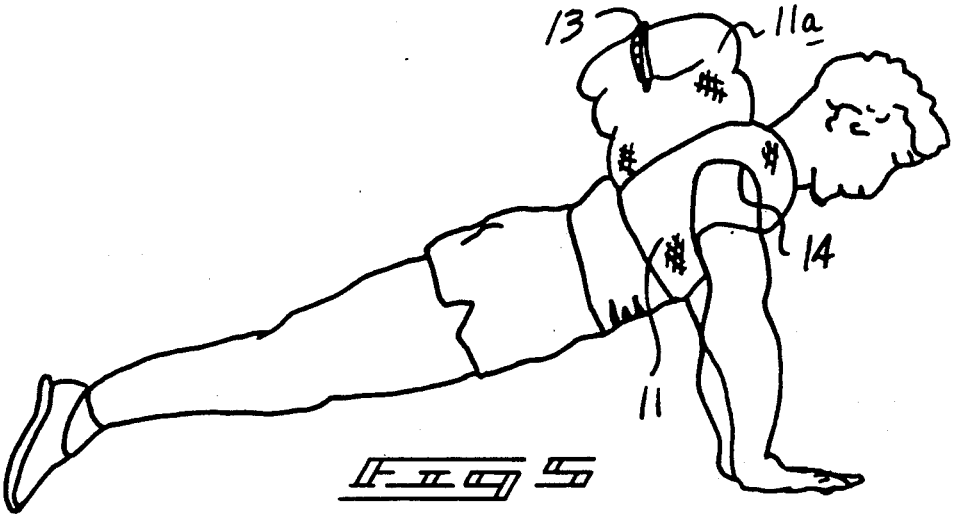
FIG. 5 is an orthographic side view of the torso vest in use by an individual.

More specifically, the exercise apparatus 10 of the instant invention essentially comprises a torso encircling vest including a vest pocket member 11*a* mounted to the vest 11 coextensively between a right and left respective arm receiving aperture 14 and 15 directed through the vest 11. A zipper 13 is arranged on the vest pocket member 11*a* providing access to a weight receiving cavity 12 defined by the vest pocket member 11*a*. A vest top edge 16 and a vest bottom edge 17 define upper and lower spaced edges of the vest 11. A right strap 18 and a left strap 19 extend laterally in opposed directions of the vest 11, with strap apertures 18*a* directed through the strap 18 and a strap buckle 19*a* mounted to a remote terminal end of the left strap 19. In this manner, a series of resistance plates 32 are positioned within the cavity 12 to provide resistance in a push-up procedure, as illustrated in FIG. 5.

Figure 6:
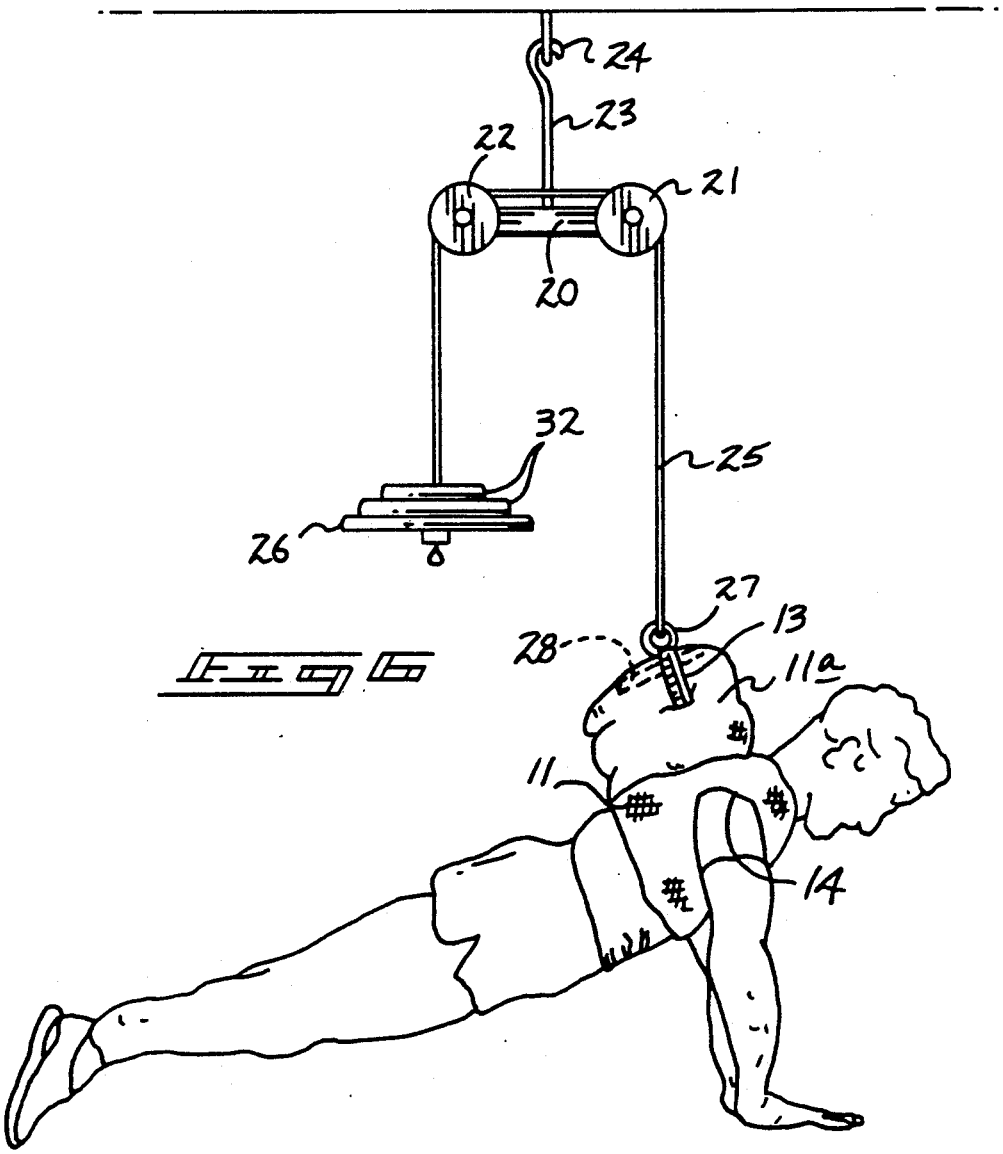
FIG. 6 is an orthographic side view, taken in elevation, of the torso vest in cooperation with assistance weights utilized by the instant invention.
Figure 7:
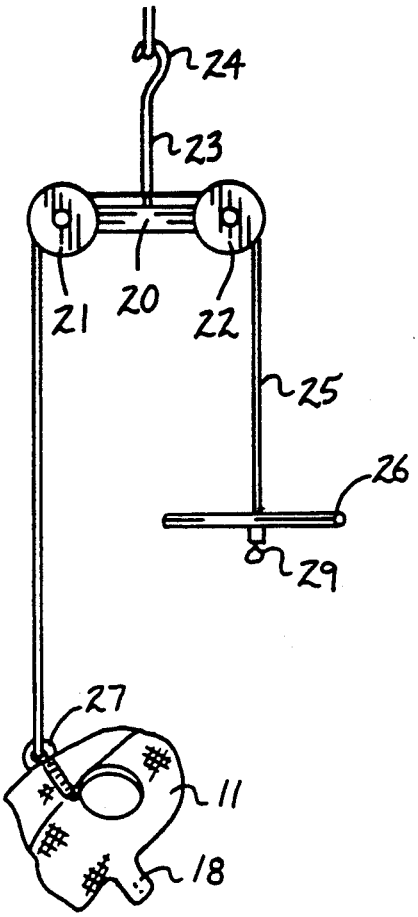
FIG. 7 is an orthographic side view, taken in elevation, of the apparatus as illustrated in FIG. 6.
Figure 8:
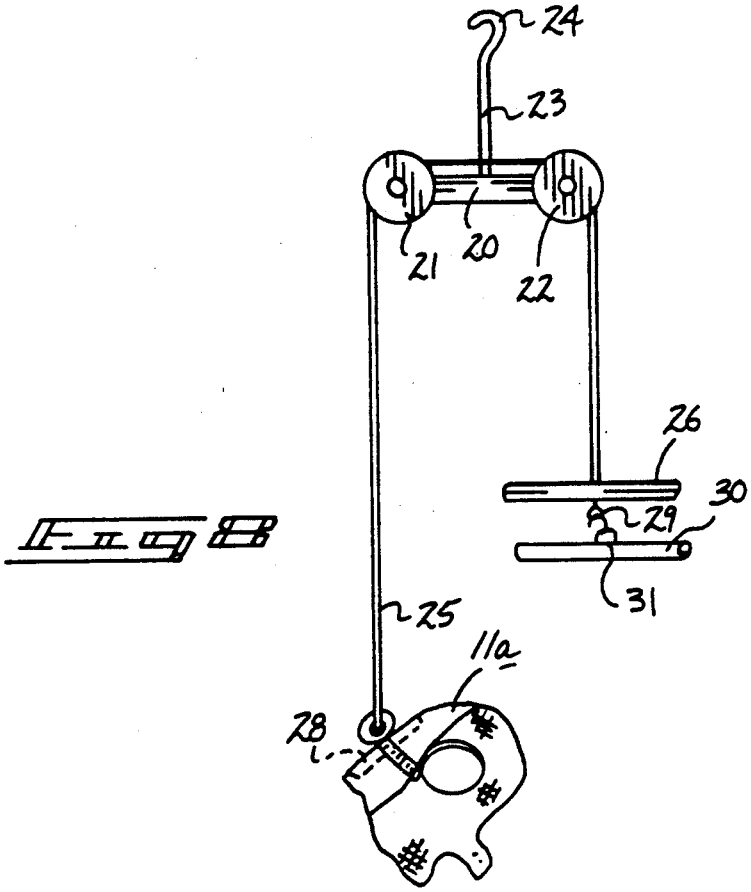
FIG. 8 is an orthographic side view, taken in elevation, of the invention utilizing a pull bar mounted to the assistance weights.

FIGS. 6–8 illustrate the use of the invention in providing assistance to an individual requiring such assistance during a training or convalescent period The apparatus includes a support plate 20 orthogonally mounting a support rod 23 to a top surface thereof, with the support rod including a support rod hook 24 formed at an upper terminal end of the support rod for reception within a loop to suspend the organization from an overhead support. A first plate 21 is mounted on a forward end of the support plate rotatably thereof, with a second pulley 22 mounted at a rear end of the support plate. An elongate flexible line 25 extends overlying the support plate 20 and the first and second pulleys 21 and 22 respectively, with a forward end of the line 25 mounting a plate member 26 thereon to receive resistance plates 32, wherein the rear end of the line 25 mounts a line loop 27 that in turn is integrally mounted medially of a mounting plate 28. The mounting plate 28 is positioned within the weight receiving cavity 12 to assist an individual in a push-up procedure, as illustrated in FIG. 6 for example. Support 29 is mounted to a bottom surface of the plate member 26 coaxially thereof and in alignment with the line 25, whereupon a bar member 30, that in turn includes a bar member hook, may be secured to the loop support 29 to provide a support bar for grasping by an individual to assist such individual in lifting subsequent to exercise, or alternatively to provide a grasping bar to provide a resistance effort in an exercise procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An exercise apparatus comprising, in combination, a torso encircling vest, the vest including a top edge spaced from a bottom edge, and a first strap member mounted to a first side of the vest and a second strap member mounted to a second side of the vest, the first strap member and second strap member securable together to secure the vest about a torso, and a right arm receiving aperture directed through the vest adjacent the top edge and first edge, with a left arm receiving aperture directed through the vest adjacent the top edge and the second edge, and a pocket member defined between the right arm receiving aperture and the left arm receiving aperture, with the pocket defining a weight receiving cavity; and a zipper extending longitudinally of the vest from the first edge to the second edge overlying the weight receiving cavity, and a plurality of resistance plates selectively positionable within the weight receiving cavity and a support plate, the support plate including a support rod, with the support rod integrally mounting a support hook to permit securement of the support plate adjacent an overlying structural component, wherein the support plate further includes a forward edge and a rear edge, with a forward pulley mounted adjacent the forward edge and a rear pulley mounted adjacent the rear edge, and an elongate flexible line extending overlying the support plate and directed about the forward pulley and rear pulley, with the flexible line including a forward end and a rear end, the forward end including a weighted plate member mounted to the forward end medially of the weighted plate member, and the flexible line rear end including a line loop, the line loop integrally medially mounted to a mounting plate, the mounting plate selectively receivable within the weight receiving cavity, and the mounting plate selectively receiving the resistance plates thereon.

2. An apparatus as set forth in claim 1 wherein the weighted plate member includes a loop support mounted to a bottom surface of the weighted plate member, and a bar member, with the bar member including a hook medially thereof, with the hook selectively securable to the loop support.

* * * * *